US012324545B2

(12) United States Patent
Bonner et al.

(10) Patent No.: US 12,324,545 B2
(45) Date of Patent: Jun. 10, 2025

(54) ELECTRONIC PAPER DISPENSER

(71) Applicants: Amber N Bonner, New Orleans, LA (US); Michelle D Davis, Simi Valley, CA (US)

(72) Inventors: Amber N Bonner, New Orleans, LA (US); Michelle D Davis, Simi Valley, CA (US)

( * ) Notice: Subject to any disclaimer, the term of this patent is extended or adjusted under 35 U.S.C. 154(b) by 1134 days.

(21) Appl. No.: 16/918,778

(22) Filed: Jul. 1, 2020

(65) Prior Publication Data

US 2021/0030219 A1 Feb. 4, 2021

Related U.S. Application Data

(63) Continuation-in-part of application No. 16/418,716, filed on May 21, 2019, now abandoned, which is a continuation of application No. 15/090,379, filed on Apr. 4, 2016, now Pat. No. 10,292,544.

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01); *A47K 2010/389* (2013.01)

(58) Field of Classification Search
CPC ..... A47K 10/38; A47K 2010/3233; A47K 2010/389; A47K 10/3827; A47K 2010/3668
See application file for complete search history.

(56) References Cited

U.S. PATENT DOCUMENTS

| | | | | |
|---|---|---|---|---|
| 4,565,335 | A * | 1/1986 | Rankin | A47K 10/38 242/598.5 |
| D314,107 | S * | 1/1991 | Lewis | D6/518 |
| D397,891 | S * | 9/1998 | Thompson | D6/524 |
| 6,628,789 | B1 * | 9/2003 | Colby | A47K 10/38 381/124 |
| 7,370,824 | B1 * | 5/2008 | Osborne | A47K 10/36 242/563.2 |
| D823,403 | S * | 7/2018 | Boyar | D21/604 |
| 2005/0211719 | A1 * | 9/2005 | Vani | A47K 10/426 221/63 |
| 2007/0012346 | A1 * | 1/2007 | Choi | F16B 7/105 135/120.3 |
| 2009/0045083 | A1 * | 2/2009 | Vaults, Jr. | A47K 10/32 206/391 |

(Continued)

FOREIGN PATENT DOCUMENTS

KR 2018105870 A * 10/2018 ..... A47K 10/38

*Primary Examiner* — Joshua E Rodden

(57) ABSTRACT

The electronic paper dispenser includes an upper compartment. The upper compartment includes an inner compartment, wherein the inner compartment contains a motion sensor, rollers, and a paper feeder. The paper feeder dispenses paper upon the activation of the motion sensor, which is in communication with a processor, which sends a signal to the rollers to release paper. The electronic paper dispenser includes an adjustable telescoping pole. The adjustable telescoping pole includes a top portion, which is connected to the upper compartment, wherein the top portion includes a height adjuster for adjusting the height of the electronic paper dispense. The adjustable telescoping pole incudes a bottom portion. The bottom portion is connected to a base.

10 Claims, 8 Drawing Sheets

(56) References Cited

U.S. PATENT DOCUMENTS

| | | | | |
|---|---|---|---|---|
| 2009/0121095 | A1* | 5/2009 | Eighmie | F16M 11/046 248/132 |
| 2014/0259534 | A1* | 9/2014 | Shields | B25G 1/04 16/429 |
| 2015/0238056 | A1* | 8/2015 | Fellhoelter | A47K 10/3687 242/560 |
| 2016/0198911 | A1* | 7/2016 | Ruiz | A47K 10/38 242/596.7 |
| 2017/0319019 | A1* | 11/2017 | Simmons | A47K 10/3836 |
| 2018/0084955 | A1* | 3/2018 | LeMaster | B65D 43/02 |
| 2019/0191941 | A1* | 6/2019 | Brunelle | A63H 3/005 |
| 2019/0290078 | A1* | 9/2019 | Moses | A47K 10/38 |

* cited by examiner

ELECTRONIC PAPER DISPENSER

BACKGROUND

Tools, which limit the amount of paper dispensed, may include paper dispensers, guards, savers, any number of tools used to prevent the waste of paper. Paper dispensers limit the amount of paper used by only allowing a certain amount of paper to be dispensed at one time. The guards and savers may include devices that attach directly to the toilet paper roll to limit unraveling of paper. The utilization of paper dispensers, guards and savers assist in eliminating the amount of waste associated with misuse of hygienic paper products.

SUMMARY

The embodiments generally relate to an electronic paper dispenser. The electronic paper dispenser may include an upper compartment. The upper compartment may an inner compartment, wherein the inner compartment includes a motion sensor, rollers, and a paper feeder. The paper feeder dispenses paper upon the activation of the motion sensor, which is in communication with a processor, which sends a signal to the rollers to release paper.

The electronic paper dispenser includes an adjustable telescoping pole. The adjustable telescoping pole includes a top portion, which is connected to the upper compartment, wherein the top portion includes a height adjuster for adjusting the height of the electronic paper dispense. The adjustable telescoping pole incudes a bottom portion. The bottom portion is connected to a base.

BRIEF DESCRIPTION OF THE DRAWINGS

The detailed description will be better understood in conjunction with the accompanying drawings as follows.

Figure 1:
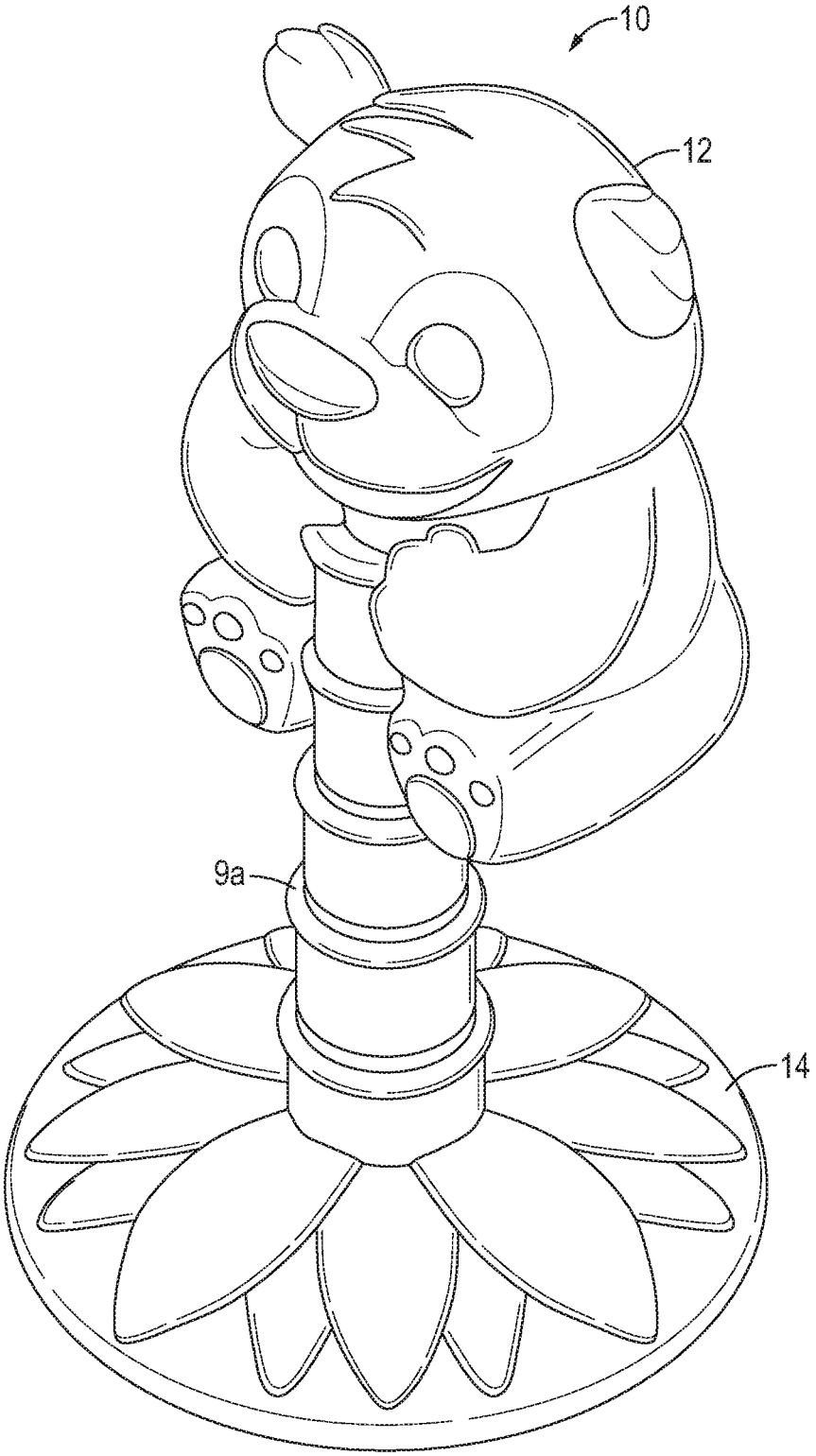
FIG. 1 depicts an electronic paper dispenser according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

In the following description of FIGS. 1-8, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment, which may be implemented in addition to, in conjunction with, or in place of the embodiments described with regard to a corresponding like-named component in any other figure.

Throughout the application, ordinal numbers (e.g., first, second, third, etc.) may be used as an adjective for an element (i.e., any noun in the application). The use of ordinal numbers is not to necessarily imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Throughout this application, elements of figures may be labeled as A to N. As used herein, the aforementioned labeling means that the element may include any number of items and does not require that the element include the same number of elements as any other item labeled as A to N. For example, a data structure may include a first element labeled as A and a second element labeled as N. This labeling convention means that the data structure may include any number of the elements. A second data structure, also labeled as A to N, may also include any number of elements. The number of elements of the first data structure and the number of elements of the second data structure may be the same or different.

In general, embodiments of the invention relate to an electronic paper dispenser. The electronic paper dispenser can be activated by the wave a hand in from of a motion sensor in communication with a processor. Upon receiving the signal, the paper is released to the user. The number of sheets released can be determined by a sheet indicator switch. Also, the height of the electronic paper dispenser can be adjusted according to the preference of the user.

FIG. 1 depicts an electronic paper dispenser (10) for electronically distributing paper. The electronic paper dispenser (10) will include an upper compartment (12), an adjustable telescoping pole (9*a*) and a base (14). The electronic paper dispenser may have multiple levels of functionality and operational control.

In one or more embodiments, the upper compartment (12) houses components for distributing paper. Also, the upper compartment (12) houses the roll of paper for distribution. The paper is distributed upon detection of a hand waving motion on the outside of the upper compartment.

In one or more embodiments, the adjustable telescoping pole (9*a*) is used to change the height of the of the electronic paper dispenser (10). Therefore, height of the electronic paper dispenser may be changed depending on the height of the user.

In one or more embodiments the base is used for stabilizing the electronic paper dispenser. The base prevents the electronic paper dispenser from being knocked over during use.

In one or more embodiments, the electronic paper dispenser may be made of shock-proof, child-safe materials which may include non-toxic foam, rubber or plastic to prevent damage and choking hazards, which allow easy clean-up and sanitizing. The electronic paper dispenser may be offered in varying shapes, sizes, colors and character designs.

Figure 2:
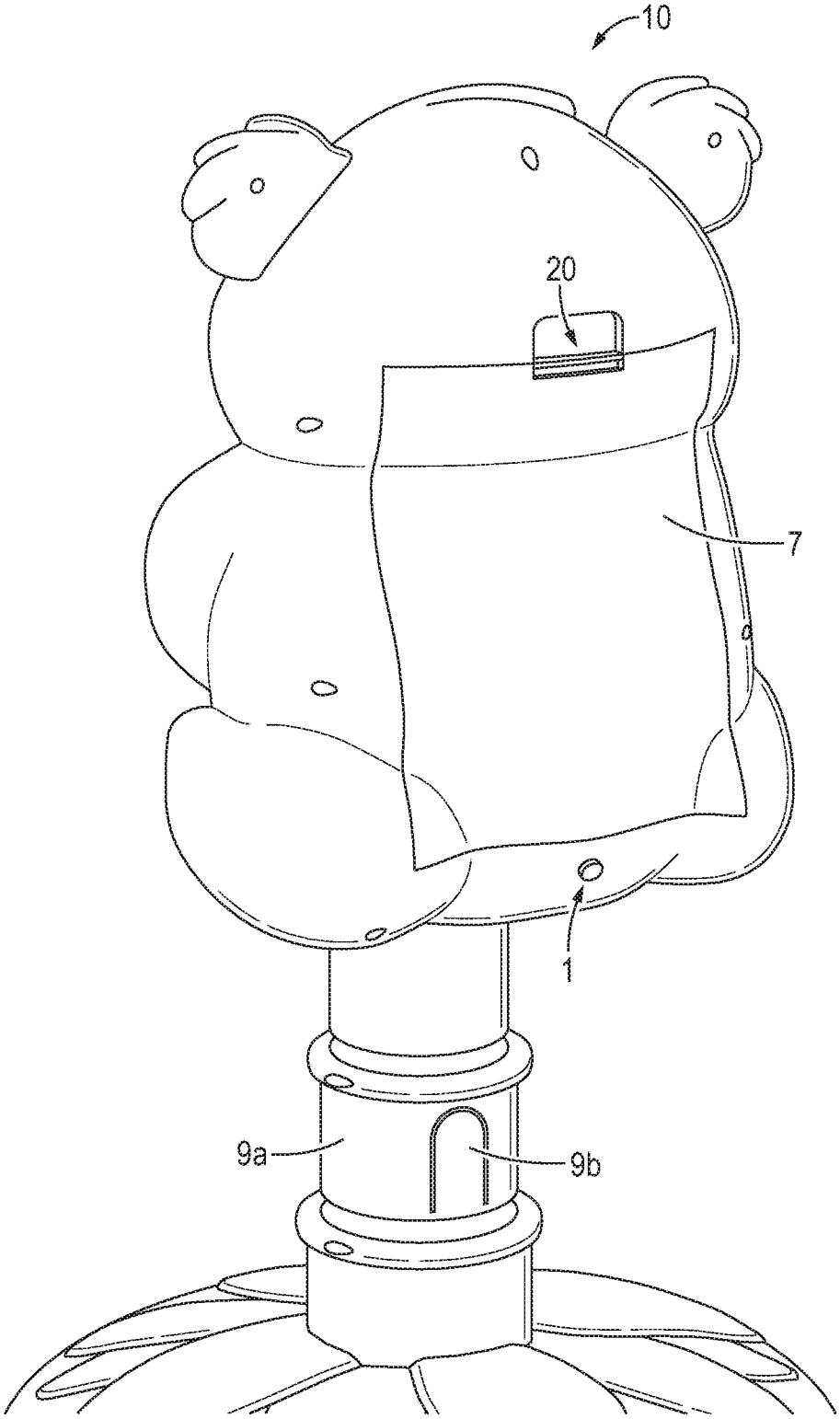
FIG. 2 depicts a back of the electronic paper dispenser with the rear door closed.

FIG. 2 depicts the back of the electronic paper dispenser with a closed rear door (7) in accordance with one or more embodiments. The back may include a rear door (7), a latch (20), a power controller, and the adjustable telescopic pole (9*a*) with a height adjuster (9*b*).

In one or more embodiments the rear door (7) may be locked or unlocked using the latch (20) to give access to the upper compartment that houses all the electronic components and the paper roll.

In one or more embodiments, the back panel contains a power controller (1). The power controller (1) may be a power on/off push button/switch. The electronic paper dispenser is powered on or off by pressing or a button (or activating a switch). Once the power controller (1) is activated, the electronic paper dispenser will be in an on state. The on state may trigger the motion sensor readiness, as well as, lights and sounds.

In one or more embodiments, when the electronic paper dispenser is not being used, the electronic paper dispenser may go into a sleep mode. In sleep mode, the electronic paper dispenser will appear to be turned off. This allows the battery life to be conserved until the user is ready to dispense more paper. The electronic paper dispenser may be reactivated by detecting a wave of a hand, which will trigger the electronic paper dispenser to release paper.

In one or more embodiments, the height adjuster (9*b*) allows height of the adjustable telescopic pole (9*a*) to be changed by pressing the height adjuster (9*b*) to unlock the lock pin to allow the adjustable telescopic pole to slide up or down.

Figure 3:
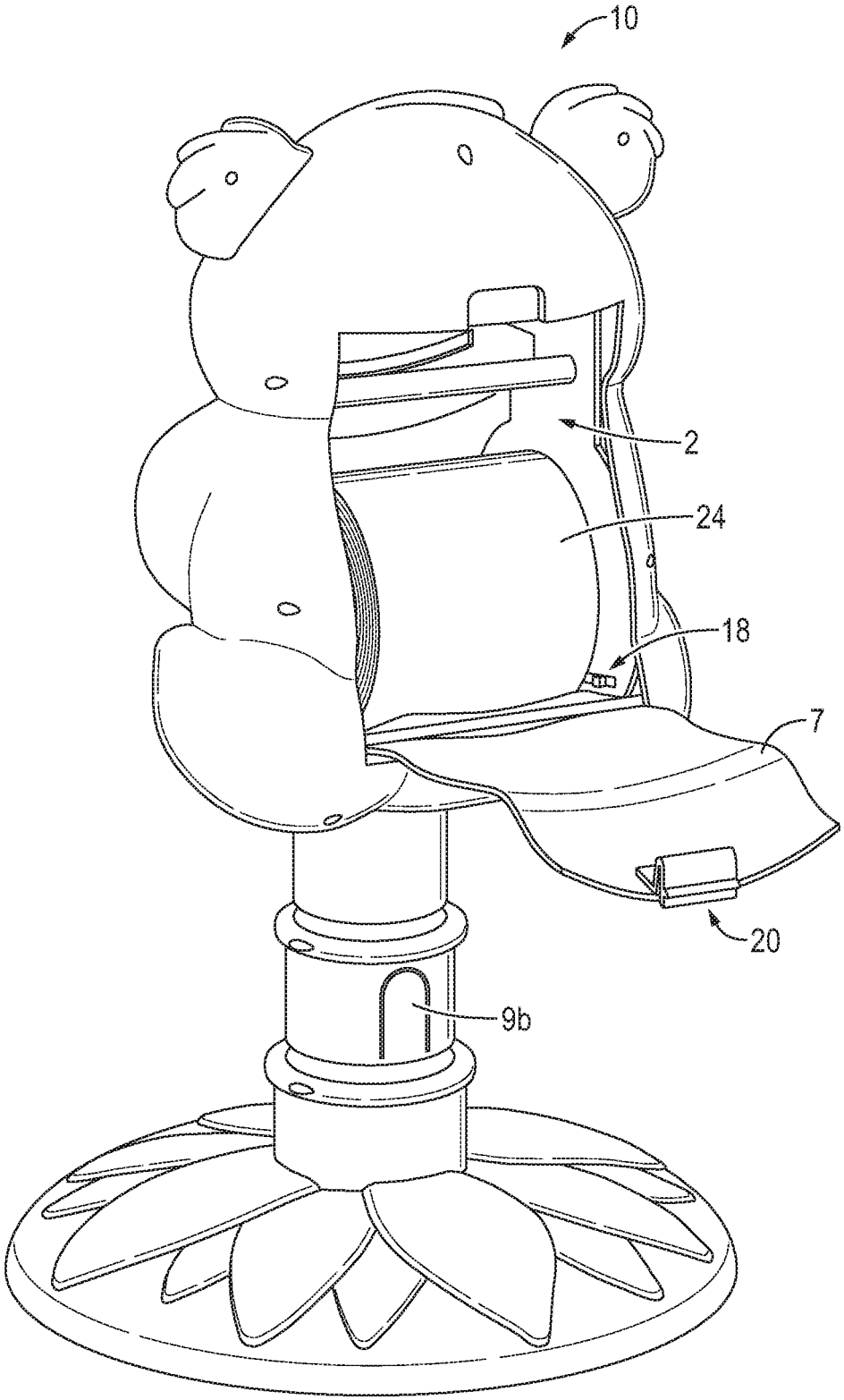
FIG. 3 depicts a back of the electronic paper dispenser with the rear door open.

FIG. 3 shows a back panel of the electronic paper dispenser with the rear door (7) open. In this instance, the rear door (7) and latch (20) are shown unlocked. To open the rear door (7), the user may squeeze on the latch (20) to unclasp and gain access to the inner compartment (2). The latch (20) may be built with child safety in mind to prevent injury to children. To close the rear door (7) the user will raise the door back up and push the latch back to its original position until they hear it click back into place, locking the device as shown in FIG. 2.

In one or more embodiments, the inner compartment (2) may include the roll of paper (24) and have a sheet indicator switch (18). The sheet indicator switch (or button) allows the user to pre-set the number of sheets of paper that will dispense at one time from the electronic paper dispenser. The sheet indicator switch (18) is in communication with a processor. The sheets setting can range from 2 sheets to 10 sheets. To prevent sheets from dispensing unintentionally, the electronic paper dispenser may pause for five to ten seconds and then reset for the next use.

Figure 4:
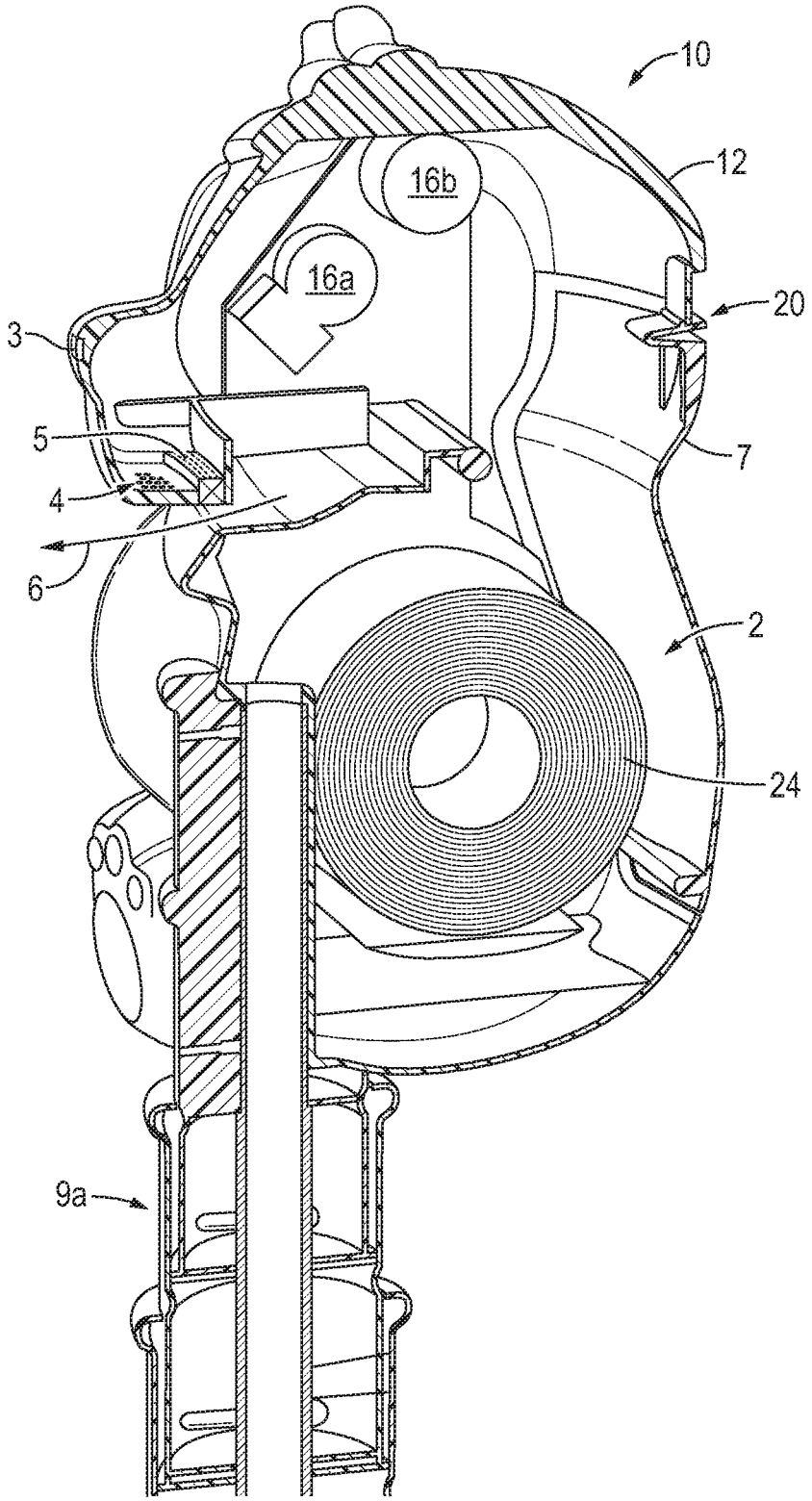
FIG. 4 depicts a detailed view of the electronic paper dispenser according to one more embodiments.

FIG. 4 shows a detailed view of the electronic paper dispenser (10). The electronic paper dispenser (10) may include an upper compartment (12) and an adjustable telescoping pole (9*a*). The upper compartment (10) includes the inner compartment (2), a motion sensor (3), lights (5), audio speakers (4), a paper feeder (6), a rear door (7), a latch (20), and a pair of rollers (16*a*, 16*b*).

In one or more embodiments, the inner compartment (2) houses the roll of paper (24) and the paper feeder/exit (6). To access the upper compartment (12), the user opens the rear door (7) by releasing the latch (20). Once the door is opened, the electronic paper dispenser may be automatically deactivated.

In embodiments, the pair of rollers (16*a*, 16*b*) is separated by an arm (not shown), which may be connected to the door. The pair of rollers (16*a*, 16*b*) provides an opening for feeding the paper through feeder/exit (6). The roll of paper may then be placed into the inner compartment (2). In embodiments, one sheet of paper (24) may be fed through the opening between the pair of rollers (16*a*, 16*b*). Upon closing the rear door, the pair of rollers (16*a*, 16*b*) is lowered, holding the paper into position; and the device is reactivated and ready for dispensing.

In one or more embodiments, the electronic paper dispenser (10) may include a motion sensor (3). The motion sensor (3) is in communication with a processor not shown. The motion sensor activates the electronic paper dispenser (10) to release paper upon sensing the wave of a hand. Once the wave of a hand is sensed, the processor sends a signal to the rollers (16*a*, 16*b*) to dispense a preset number of sheets through the paper feeder (6).

In one or more embodiments, the upper compartment (12) may include a cutting device (not shown). The cutting device is located in the inner compartment (2) of the upper compartment (12) and between safety barriers to assist with detaching the paper from the roll. The cutting device may be placed in a location, which prevent the injuries. In embodiments, the cutting device may cut completely through the paper or partially, leaving the paper to loosely hang from the mechanism in a manner that is easy to tear free.

Figure 5:
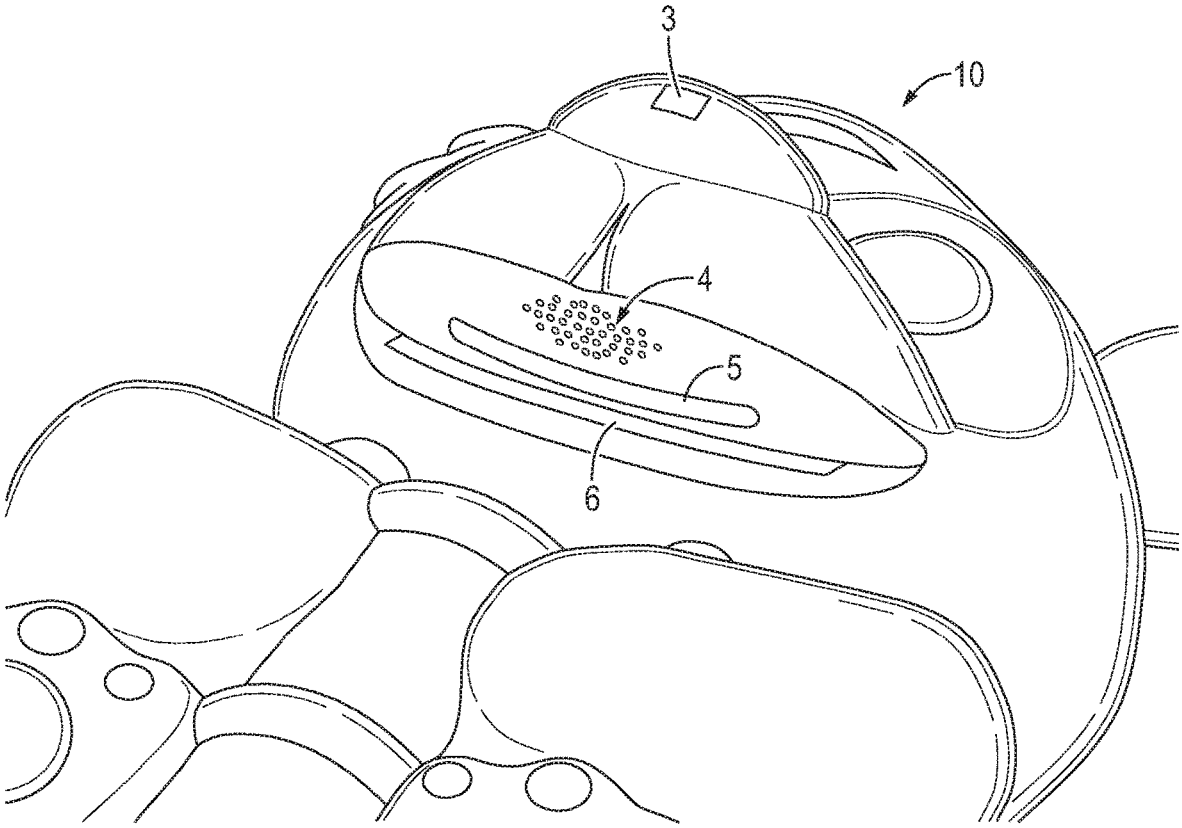
FIG. 5 depicts a front view of the electronic paper dispenser according to one or more embodiments.

FIG. 5 shows a front view of the electronic paper dispenser (10). In one or more embodiments the motion sensor (3) may be contained in the nose area, which will detect passive motion and active waving—with up close, active waving, serving as the trigger to the feeder (6) for paper dispensing. As the paper exits the feeder (6), lights (5) may illuminate the paper. The lights may be light emitting diodes (LEDs) or any other type of light source.

In one or more embodiments, audio speakers (4) may be located in the roof of the mouth. The audio speakers (4) may project sounds while the paper is being dispensed. The lights and the sound may with turn off once the dispensing is complete.

Figure 6A:
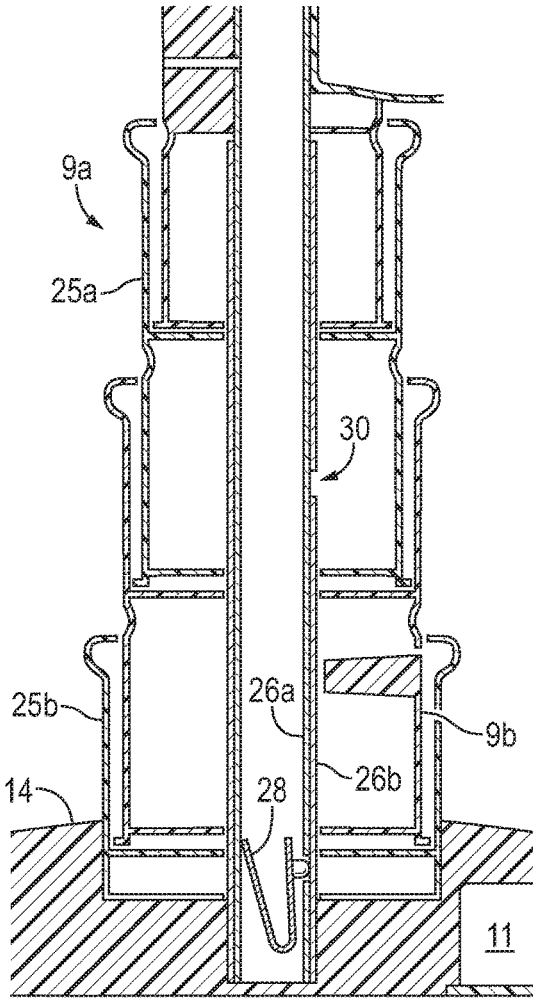
FIGS. 6A-6B show a detailed view of the telescoping pole according to one or more embodiments.
Figure 6B:
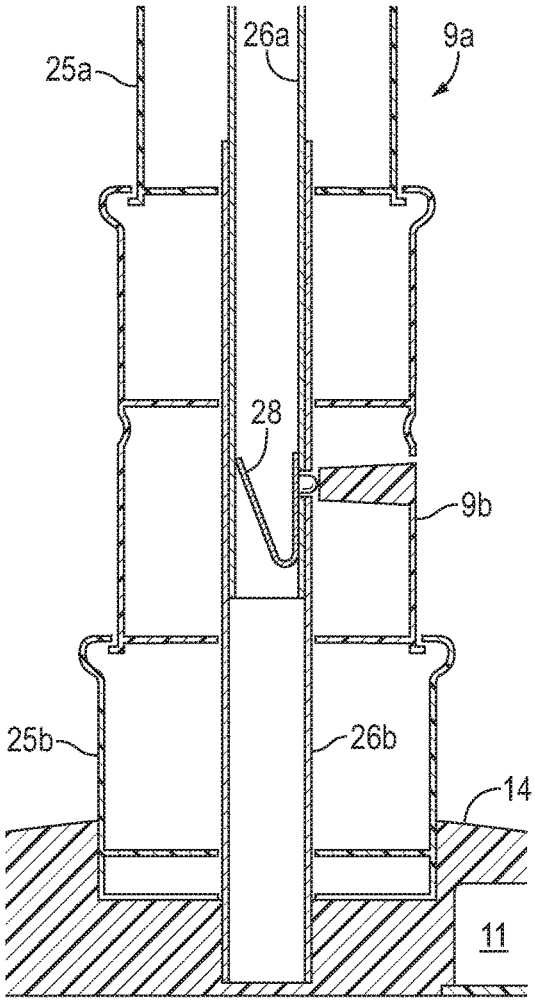

FIGS. 6A-6B show a detailed view of the telescoping pole (9*a*) in a lowered and raised positions according to one or more embodiments. The telescoping pole (9*a*) includes a top portion 25*a* and a bottom portion 25*b*. The top portion (25*a*) and bottom portion (25*b*) contain a first inner pole (26*a*) and a second inner pole (26*b*).

In one or more embodiments top portion (25*a*) of the telescoping pole (9*a*) may include the height adjuster (9*b*) for adjusting the height of the telescoping pole (9*a*). The height adjuster (9*b*) may be a u-shaped tab (shown in FIG. 2 and FIG. 3). The u-shaped tab may have a protrusion on the inside of the tab. The bottom portion (25*b*) of the telescoping pole (9*a*) is attached to the base (14). The base includes a battery compartment (11).

In one or more embodiments, the second inner pole (26*a*) may include height holes (30). A small metal lock pin (28) may be located inside of the first inner pole (26*a*). The lock pin (28) may be a spring leg snap button, a push button lock pin, or other suitable system. The lock pin (28) connects the top portion (25*a*) of the telescoping pole (9*a*) to the bottom portion (25*b*) of the telescoping pole (9*a*). Upon compression of the height adjuster (9*b*), the lock pin (28) may be released from one height hole of the second inner pole (26*b*)

and slid into another one of the height holes to securely set the height of the adjustable telescoping pole (9*a*) to a desired height setting.

Figure 7A:
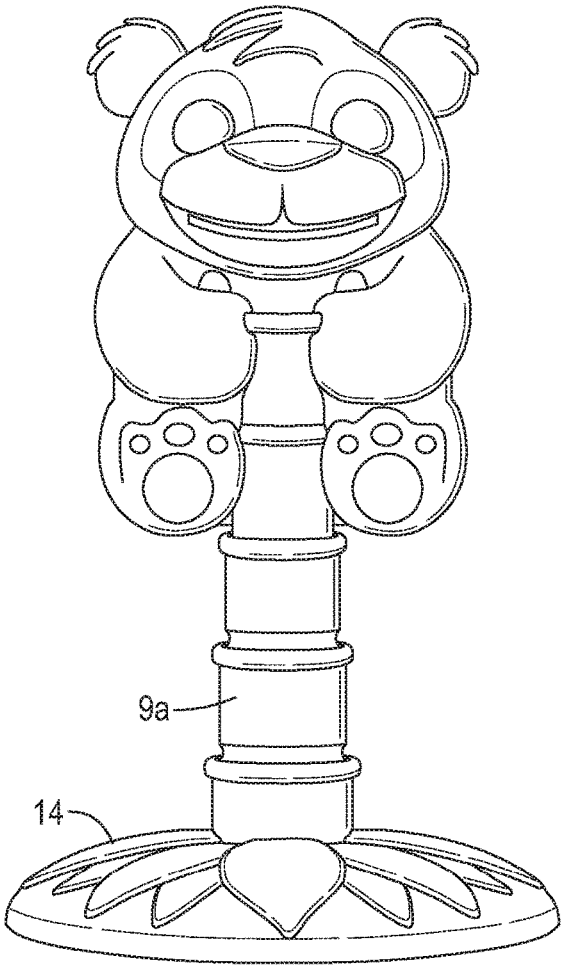
FIGS. 7A-7B depicts perspective view and adjustable range of the adjustable telescoping pole according to one or more embodiments.
Figure 7B:
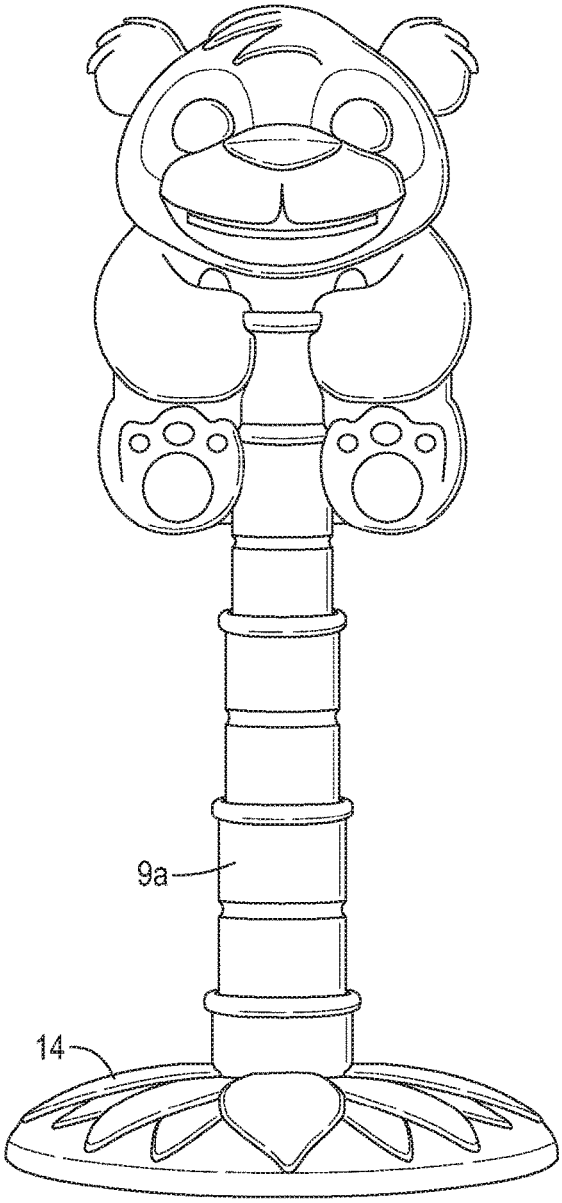

FIGS. 7A-7B shows the perspective view and adjustable range of the adjustable telescoping pole (9*a*) with height adjuster and base (14). In embodiments, the adjustable telescoping pole (9*a*) is shown lowered to a minimum height and raised to a maximum height.

Figure 8:
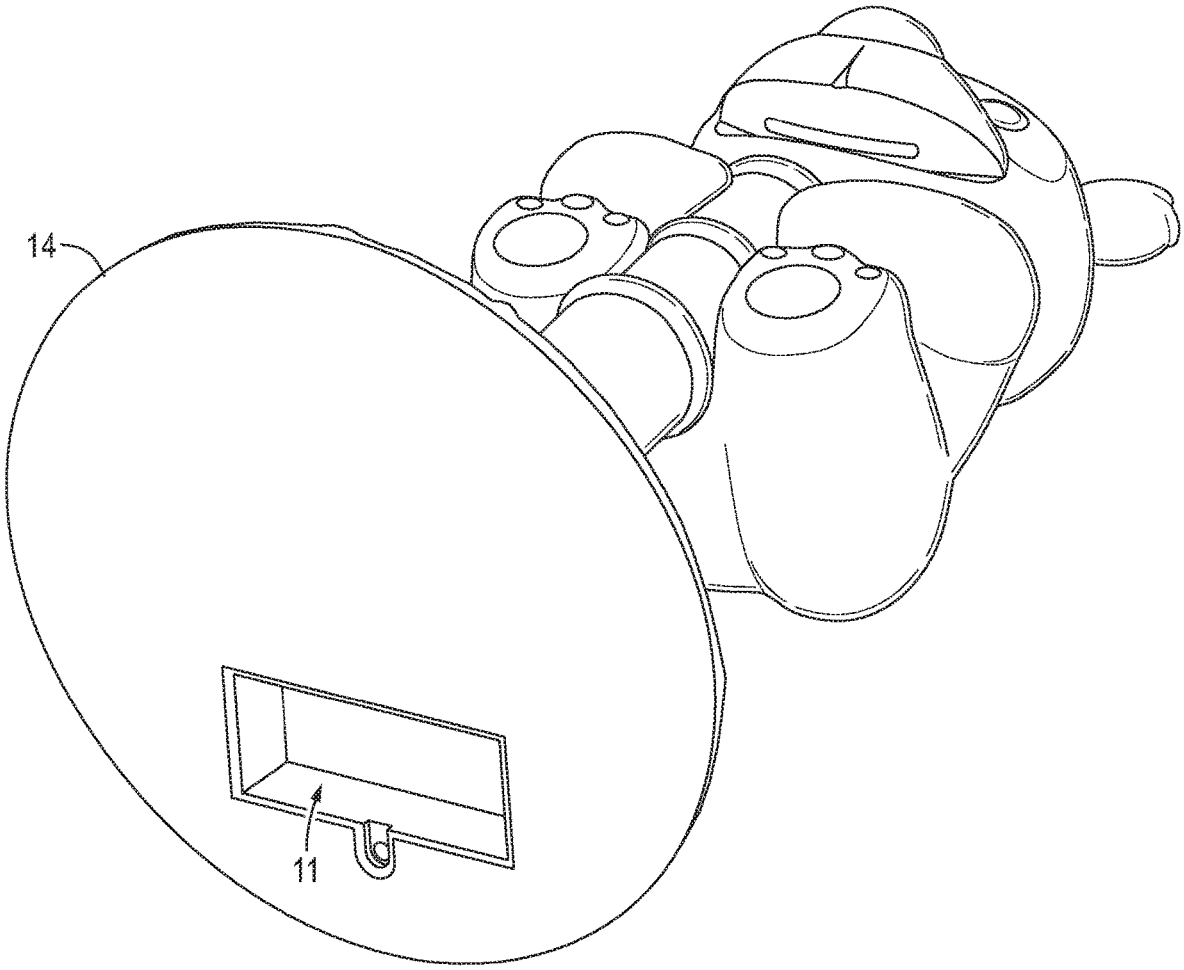
FIG. 8 depicts a perspective view of the battery compartment.

FIG. 8 shows the perspective view of the battery compartment (11) located in the base (14) of the product. In embodiments, the power source may be a lithium battery. In other embodiments the electronic paper dispenser may include an adapter for plugging the dispenser into a source.

The embodiments provide a sanitary way to receive paper with touching the paper dispenser.

The embodiments provide an easy-to-use tool that will reducing waste while training the operator to use proper amounts of paper.

While these embodiments have been described with emphasis on the embodiments, it should be understood that within the scope of the appended claims, the embodiments might be practiced other than as specifically described herein.

What is claimed is:

1. An electronic paper dispenser, comprising:

a. an upper portion having a physical form of an animal character;

b. an inner compartment within said upper portion comprising;

(i) a motion sensor, which is configured to detect a wave of a hand;

(ii) lights;

(ii) audio speakers; and (iv) a paper feeder, wherein the paper feeder dispenses paper upon activation of the motion sensor, which is in communication with a processor, which sends a signal to the paper feeder to release paper;

wherein the lights illuminate and the audio speakers play sound simultaneously as the paper is being dispensed; and where in the lights and audio speakers turn off once the paper has been dispensed.

2. The electronic paper dispenser of claim 1, wherein a top portion of an adjustable telescoping pole further comprises a first inner pole.

3. The electronic paper dispenser of claim 2, wherein a lock pin is located inside the first inner pole for connecting the top portion of the adjustable telescoping pole to a bottom portion of the telescoping pole.

4. The electronic paper dispenser of claim 3, wherein the bottom portion comprises a second inner pole.

5. The electronic paper dispenser of claim 4, wherein the second inner pole comprises height holes.

6. The electronic paper dispenser of claim 2, wherein the telescoping pole includes a height adjuster is a u-shaped tab with a protrusion on a inside of the u-shaped tab.

7. The electronic paper dispenser of claim 3, wherein the telescoping pole is adjusted by compressing a height adjuster to release the lock pin from one height hole while sliding the top portion to another height hole to reach a desired height setting.

8. The electronic paper dispenser of claim 1, wherein the inner compartment comprises a sheet indicator switch for setting a number of sheets of paper, dispensed upon activation of the motion sensor.

9. The electronic paper dispenser of claim 1, further comprising:

a. an adjustable telescoping pole, comprising;

(i) a top portion, which is connected to the upper portion, wherein the top portion comprises a height adjuster for adjusting a height of the electronic paper dispenser; and (ii) a bottom portion, which is connected to a base.

10. An electronic paper dispenser, comprising:

an upper portion having a physical form of an animal character;

a telescoping pole having first and second end portions, wherein a length of said telescoping pole being adjustable over at least a portion of a distance between said first and second end portions and wherein said upper portion is coupled to said first end portion of said telescoping pole;

a base support adapted for resting on a generally flat surface, wherein said second end portion of said telescoping pole being coupled to said base support;

a height retention device in operating engagement with said telescoping pole for fixing the length of said telescoping pole between said first and second end portions at a distance determined by a user of said electronic paper dispenser;

a a paper feeder integrally formed within a interior of said upper portion and being adapted for dispensing paper upon command;

a motion sensor configured to detect a presence and absence of motion;

status lights for indicating an operational status of said paper dispenser;

warning lights for indication the presence of a hazardous condition associated with the operation of said paper dispenser;

an audio speaker for playing predetermined sounds;

a control unit for controlling the operation of said paper feeder, said motion sensor, said status lights, said warning lights and said audio speaker.

* * * * *